US010541478B1

(12) United States Patent
King, Jr. et al.

(10) Patent No.: US 10,541,478 B1
(45) Date of Patent: Jan. 21, 2020

(54) INSULATION DISPLACEMENT CONNECTOR

(71) Applicant: The Patent Store LLC, O'Fallon, MO (US)

(72) Inventors: L. Herbert King, Jr., Chesterfield, MO (US); James Keevan, O'Fallon, MO (US); William Hiner, O'Fallon, MO (US)

(73) Assignee: The Patent Store, LLC, Jefferson City, MO (US)

( * ) Notice: Subject to any disclaimer, the term of this patent is extended or adjusted under 35 U.S.C. 154(b) by 0 days.

(21) Appl. No.: 15/732,218

(22) Filed: Oct. 4, 2017

(51) Int. Cl.
*H01R 4/24* (2018.01)
*H01R 4/2433* (2018.01)
*H01R 43/01* (2006.01)
*H01R 4/70* (2006.01)

(52) U.S. Cl.
CPC ..... *H01R 4/2433* (2013.01); *H01R 43/01* (2013.01); *H01R 4/70* (2013.01)

(58) Field of Classification Search
CPC ..... H01R 43/01; H01R 4/2433; H01R 4/70
USPC ..... 439/401, 402, 403
See application file for complete search history.

(56) References Cited

U.S. PATENT DOCUMENTS 3,388,370 A * 6/1968 Elm ..... H01R 4/24 439/402
3,804,971 A * 4/1974 Bazille, Jr. ..... H01R 4/2433 174/88 R
3,899,236 A * 8/1975 Santos ..... H01R 4/2433 439/402
3,912,356 A * 10/1975 Johansson ..... H01R 4/2454 439/400
4,954,098 A * 9/1990 Hollingsworth ..... H01R 4/2433 439/404
5,147,217 A * 9/1992 Neale, III ..... H01R 4/2433 439/403
5,567,173 A * 10/1996 Franckx ..... H01R 4/2433 439/403
5,735,706 A * 4/1998 Ito ..... H01R 4/2433 439/402
5,746,610 A * 5/1998 Shiu ..... H01R 4/646 439/402
6,139,352 A * 10/2000 Daoud ..... H01R 4/2433 439/404
7,093,858 B1 8/2006 Russell
7,178,114 B2 2/2007 Lin et al.
7,195,513 B1 * 3/2007 Gherardini ..... F16L 3/1025 439/401
7,252,551 B2 * 8/2007 Ueno ..... H01R 4/2433 439/404
7,297,029 B2 * 11/2007 Ueno ..... H01R 9/226 439/404

(Continued)

*Primary Examiner* — Abdullah A Riyami
*Assistant Examiner* — Nelson R. Burgos-Guntin
(74) *Attorney, Agent, or Firm* — Michael Best & Friedrich LLP

(57) ABSTRACT

A method and apparatus for forming a blind connection between a first wire and a second wire where each of the wires are inserted into a sleeve with the first wire laterally inserted into the sleeve for positioning along the first wire and the second wire axially inserted through the sleeve and into engagement with a stop located outside the sleeve to ensure that the second wire is properly positioned in the sleeve before an unseen electrical connection is formed between the first wire and the second wire.

19 Claims, 5 Drawing Sheets

(56) References Cited

U.S. PATENT DOCUMENTS

| | | | | |
|---|---|---|---|---|
| 7,448,900 | B1 * | 11/2008 | Chen | H01R 4/2412 439/402 |
| 7,611,374 | B1 * | 11/2009 | Chiu | H01R 4/2454 439/402 |
| 7,695,308 | B2 * | 4/2010 | Allwood | H01R 4/2433 439/402 |
| 7,950,956 | B2 | 5/2011 | Hiner et al. | |
| 8,007,310 | B2 * | 8/2011 | Landis | H01R 4/2433 439/404 |
| 8,246,361 | B2 * | 8/2012 | Dennes | H01R 4/2433 439/107 |
| 8,444,431 | B1 * | 5/2013 | La Salvia | H01R 4/2408 439/404 |
| 8,481,868 | B2 * | 7/2013 | Dennes | H01R 4/2433 174/549 |
| 8,637,774 | B2 | 1/2014 | King, Jr. et al. | |
| 8,678,852 | B2 * | 3/2014 | Rineau | H01R 4/2408 439/402 |
| 9,472,869 | B2 | 10/2016 | King, Jr. et al. | |
| 9,496,626 | B2 | 11/2016 | King, Jr. et al. | |
| 9,887,469 | B1 * | 2/2018 | King, Jr. | H01R 4/2454 |
| 2010/0155135 | A1 * | 6/2010 | Yamamoto | F21V 21/002 174/536 |
| 2012/0329309 | A1 * | 12/2012 | Weaver | H01R 4/242 439/404 |
| 2013/0224988 | A1 * | 8/2013 | Bishop | H01R 4/2433 439/389 |
| 2015/0288078 | A1 * | 10/2015 | King, Jr. | H01R 4/2433 174/70 R |
| 2015/0311607 | A1 * | 10/2015 | Ding | H01R 4/2416 439/402 |
| 2016/0218444 | A1 * | 7/2016 | King, Jr. | G01N 27/045 |

* cited by examiner

INSULATION DISPLACEMENT CONNECTOR

BACKGROUND OF THE INVENTION

Insulation displacement connectors are well known in the art and typically comprise a pair of cantilevered spaced apart blade members each having an internal edge for penetrating through an outer insulation wire cover to bring the internal edges into electrical contact with the electrical wire. The insulation displacement connectors, which are often referred to as IDC connectors, allow one to quickly form an electrical connection between an insulation covered electrical wire and the blade members of the IDC connector without having to manually remove the insulation covering on the wire. The spacing of the blunt edges of the blade from each other are sized so that when an electrical wire with an insulation covering is forced between the blunt edge blades the blunt edged blades penetrate through the soft insulation covering to bring the blunt edge of the blades into electrical contact with the electrical wire without damaging the electrical wire. Typically, the spacing between the blades is wider at the top to facilitate insertion of the insulation-covered wire between the blades. An example of an insulation displacement connector with joined blades is shown in U.S. Pat. No. 9,496,626 where an insertable cover carrying a set of blades can be forced downward into engagement with a main wire located in the housing and a branch wire with the blades simultaneously forcing the insulation from the main wire and the branch while forming an electrical path between the two wires. This type of wire connector has the benefit of allowing one to simultaneously form electrical connections to branch wires by forcing a cover having a set of blades into physical engagement with wires located therein.

Although wire connectors with joined blades may be used in many fields one of the fields well suited for use of joined blade connectors is with tracers wires since frequently a branch tracer wire, which is located along a branch pipeline, needs to joined or tapped into an electrical connection with a main tracer wire that follows a main pipeline. For example, to identify the location of underground pipelines and branch pipelines one forms an electrical branch connection between a main tracer wire, which follows the main pipeline, and a branch tracer wire, which follows the branch pipeline, preferably without cutting the main tracer wire. Examples of various types of tracer wire connectors can be found in U.S. Pat. Nos. 7,179,114; 8,637,774; 7,950,956; 7,093,858 and 7,179,114.

Typically, to connect two tracer wires together may require one hand to hold a set of wires in position for electrical engagement while also supporting one section of a two-part connector and with the other hand align a second section of the two-part connector with the first section of the two-part connector. Next, one engages the parts of the two-part connector to each other to form an electrical connection of the wires therein. Connections that require wire alignment before securement are typically best suited for two people since one person can hold the wires in position while the other person aligns the wires and engages the two parts of the two-part wire connector with each other.

U.S. Pat. No. 9,472,869 discloses an example of insulation displacement wire connector having a pair of opposed rotateable pivot arms that can be separately rotated from an open condition to a closed or locked condition. Rotating one of the pivot arms bring the electrical wire with an insulation cover thereon between resilient tabs or blunt edge blades on an edge connector to simultaneously bring an electrical wires into electrical contact with the edge conductor. Rotating the other pivot arms brings the other electrical wire with an insulation cover thereon between a set of further resilient tabs or blunt edge blades on an edge connector to simultaneously bring the electrical wire into electrical contact with the edge conductor and into electrical contact with the other electrical' wire through the electrical engagement of the edge connector with each other.

One of difficulties with forming a branch attachment to a main wire is that one needs to ensure that the branch electrical wires are properly positioned in the wire connector before the electrical connections are formed. Sometimes field conditions as well as other conditions make it difficult to determine if the branch wire is properly positioned for forming an electrical connection thereto.

SUMMARY OF THE INVENTION

An insulation displacement connector using a blind connection for reliably splicing a branch wire to a main wire without cutting the main wire. The connector having an insulation filled cover with a foldable lid attached thereto with the lid carrying a sleeve having a side opening for latterly inserting and axially positioning the connector along an uncut main wire therein and a cylindrical opening extending therethrough for axially inserting a cantilevered end of a branch wire through the cylindrical opening in the sleeve and into engagement with a wire stop located in axial alignment with the cylindrical opening. Although a blind connection is formed within the sleeve the wire stop, which is spaced from the sleeve, enables the operator to visually confirm that a cantileverly extending branch wire is in proper connecting position within the sleeve so that one can proceed to simultaneously form an electrical connection between both the branch wire, which has a cut end, and the main uncut wire by forcing a piston carrying a set of blade connectors downwardly into the sleeve and into physical and electrical engagement with an unseen portion of the branch wire and an unseen portion of the main uncut wire located in the sleeve.

DESCRIPTION OF THE PREFERRED EMBODIMENT

Figure 1:
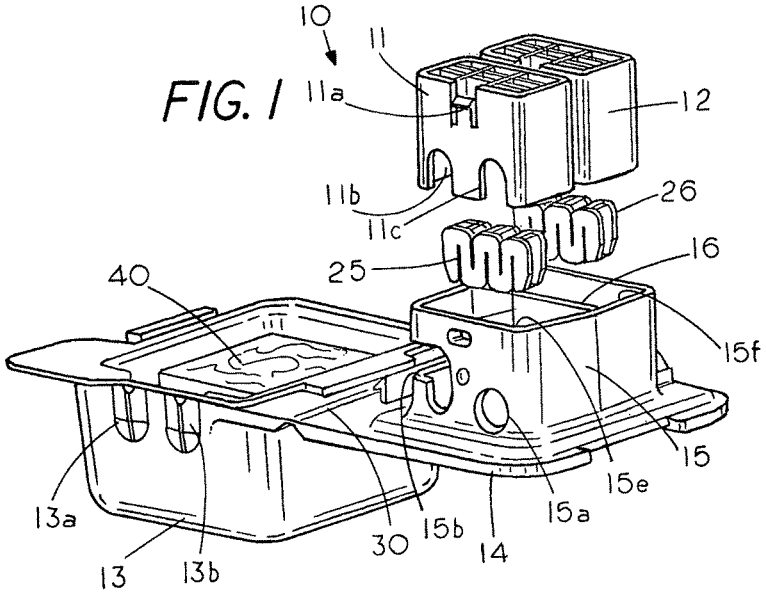
FIG. 1 is a perspective exploded view of the insulation displacement connector.

FIG. 1 is a perspective exploded view of an insulation displacement connector 10 showing a sealant 40 located in a cover 13 that is connected to a lid 14 through a living hinge 30. Located on lid 14 is a rectangular shaped sleeve 15 having a first rectangular shaped piston compartment 15*e* and a second rectangular shaped piston compartment 15*f* with a divider 16 extending therebetween. A first edge blade connector 25 is shown located above compartment 15*e* and below a slideable piston 11 having a chamber 11*b* for mounting the blunt edge blade connector 25 therein. A second identical blunt edge blade connector 26 is shown located above compartment 15*d* and below a slideable piston 12 having an identical chamber therein for mounting the blunt edge blade connector 26 therein with each having blunt edge blades therein. In this example, piston 12 and piston 11 are independently slideable into an electrical connection with the wires therein. The blunt edge blade connectors 25 and 26 are of the type shown in U.S. Pat. No. 9,496,626. The use of two side-by-side blunt edge blade connectors 25 and 26 each having each having at least two sets of blunt edge blades minimize or eliminates wire failure connections since multiple blades engage each of the wires therein to provide multiple parallel electrical connections to the wires therein. Although more or less blade connectors may be used the invention is shown herein with the use of two sets of blade connectors 25 and 26, which increases the connector contact with the wires to increase the resistance to wire pull out or sliding within the connector. Connector 10 is well suited for use as a tracer wire connector with underground pipelines where one connects a tracer wire that follow a main pipeline to a tracer wire that follows a branch pipeline. In the event work needs to be performed on the pipelines one can quickly locate the position of the pipelines through detection of the tracer wires. With the connector shown herein the tracer wire that follows the main pipeline does not have to be cut and spliced to a branch wire, which follows a branch pipeline, since the branch wire attaches to a main wire through a blind connection within connector 10.

Figure 2:
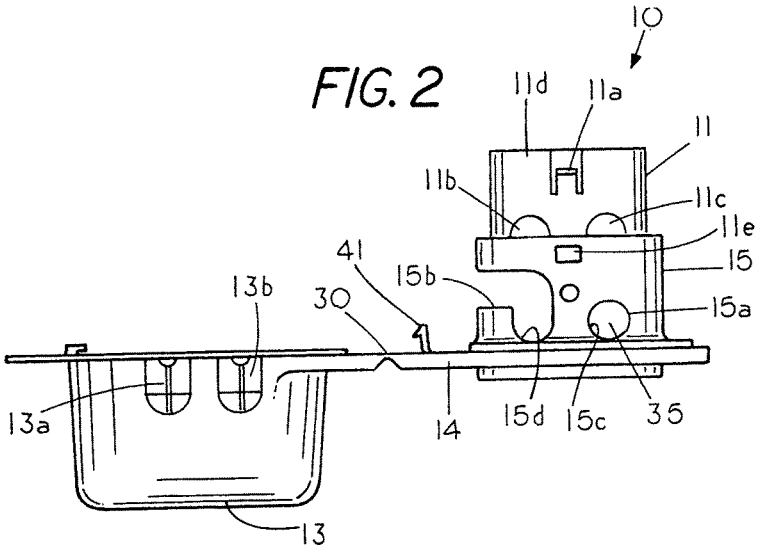
FIG. 2 is a front side view of the insulation displacement connector of FIG. 1 in a position to connect electrical wires therein.

FIG. 2 is a side view showing the insulation displacement connector 10 in a position for attaching a branch tracer wire to a main tracer wire without having to cut the main wire since connector 10 can receive both an uncut main wire and a cut branch wire. The piston 11, which holds the blunt edge blade connector 25 therein, contains a first U-shaped recess opening 11*c* and a second U-shaped recess opening 11*b*. The U-shaped recess opening 11*b* is in vertical or axial alignment with a U-shaped wire cradle 15*d* and the second U-shaped recess opening 11*c* is in vertical or axial alignment with a circular wire cradle 15*c*. Piston 11, which is shown in FIG. 1, holds blade connector 25 with piston 12 identical to piston 11 in its alignment of recesses for receiving both an uncut wire located in wire cradle 15*d* and a cut wire located in wire cradle 15*c*.

Figure 7:
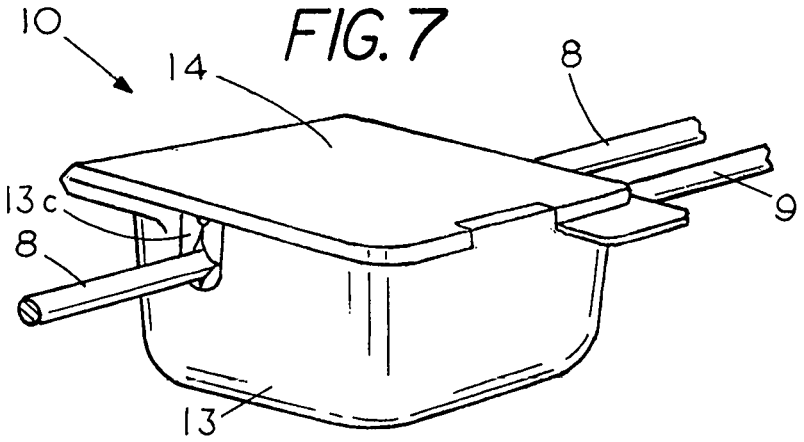
FIG. 7 is a perspective view of the insulation displacement connector in the closed mode with a connection formed between an uncut wire and a cut wire.

FIG. 2 and FIG. 7 show that cover or housing 13 contains two sets of resilient flexible flaps 13*a* and 13*b* on one side and a further set of resilient flexible flaps 13*c* on the opposite side. FIG. 7 shows the resilient flaps flex to allow a wire to be latterly inserted therein to maintain the sealant 40 in the cover 13 while allowing the wires to extend outward from the interior of the cover when the connector is in a closed condition for underground burial.

FIG. 2 shows piston 11 located partially within piston compartment 15*c* of piston sleeve 15 with the piston 11 in an up position. Piston 11 and piston sleeve 15 are in alignment with each other. Applying pressure on top surface 11*d* of piston 11 forces piston 11 axially downward into the piston sleeve 15. Piston sleeve 15 includes a lateral or side opening 15*b* that allows an uncut wire to be latterly inserted into an arcuate shaped wire cradle 15*d* in piston sleeve 15 without having to cut the wire. In this example a second wire, such as a branch wire, which has a cut end, can be axially inserted into cylindrical opening 15*a* of piston sleeve 15 with the cylindrical opening 15*a* also having an arcuate shape wire cradle 15*c*. A resilient latch 11*a* engages a further latch 11*e* in sleeve 15 to hold piston 11 in the down or wire engaging position once the blade connector 25 in piston 11 has formed an electrical connection with the wires in the sleeve 15.

Figure 3:
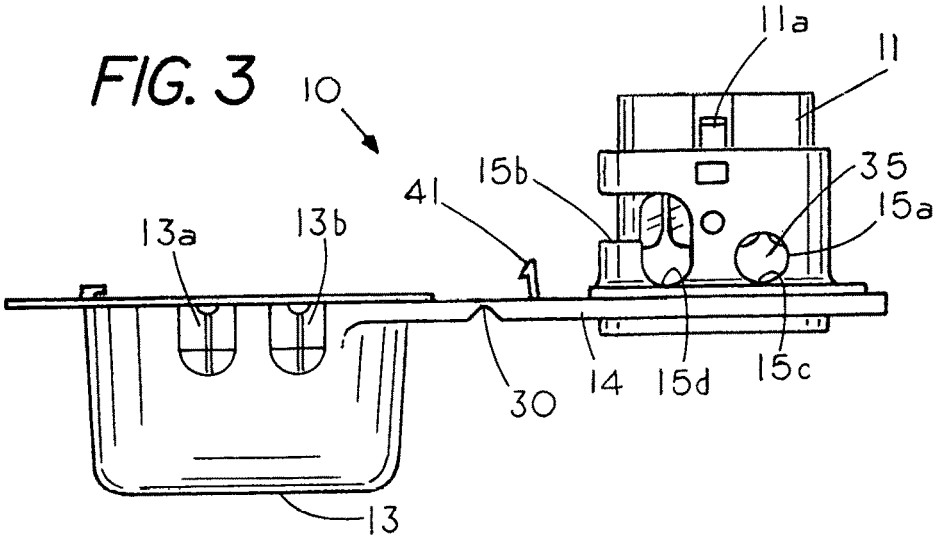
FIG. 3 is a front side view of the insulation displacement connector of FIG. 1 with a piston partially engaged.

FIG. 3 shows a side view of connector 10 without wires therein to show piston 11 partially extended downward. Note, when the piston 11 is extended partially downward a wire cannot be laterally inserted into the wire cradle 15*d*. Therefore, by maintaining the piston 11 in a slightly higher elevation as shown in FIG. 2 one can laterally insert an main wire into the wire opening 15*b* without having to cut the wire.

Figure 4:
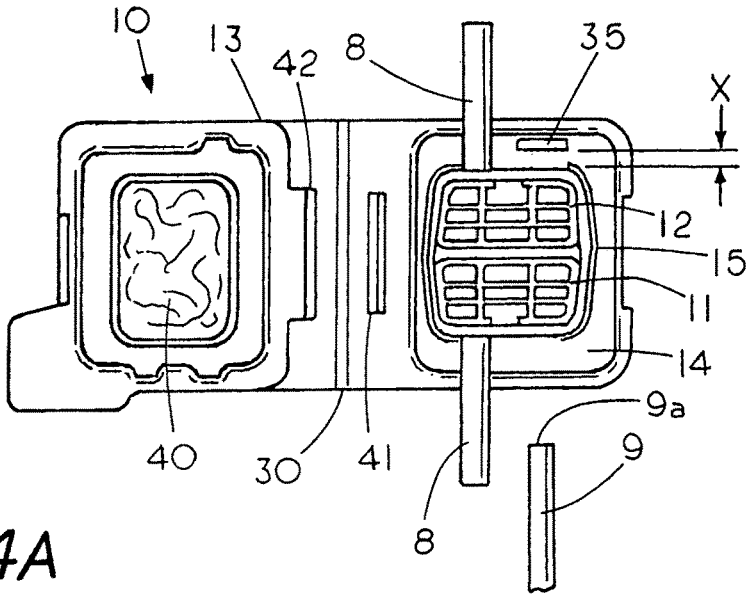
FIG. 4 is a top view of the insulation displacement connector of FIG. 1 showing an uncut wire located in the wire sleeve and a cut wire about to be inserted into the wire sleeve.
Figure 5:
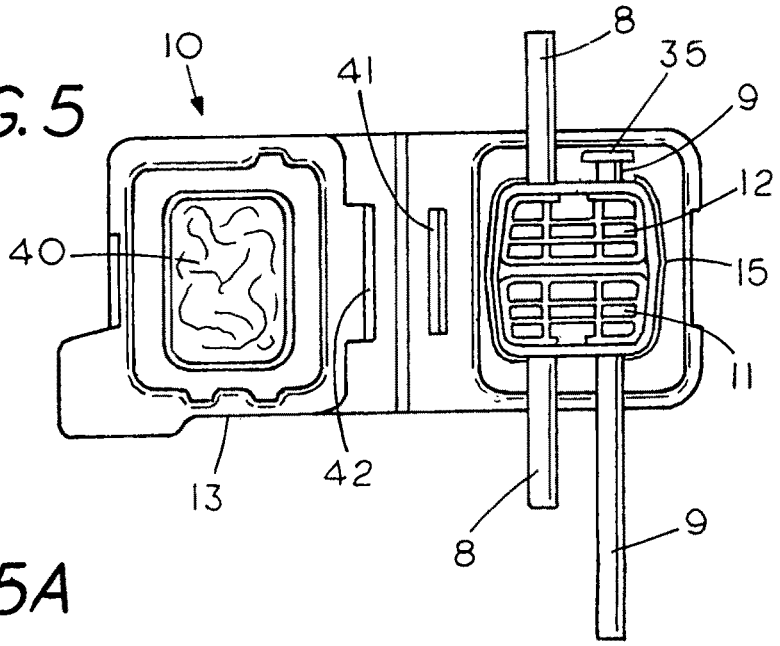
FIG. 5 is a partial side view of a wire spaced from a wire stop of the insulation displacement connector.

FIG. 4 shows a top view of connector 10 with an uncut or main wire 8 extending through the piston sleeve 15 and a second wire comprising a tap wire 9 having a cut end 9*a* about to inserted into the cylindrical opening 15*a* (see FIG. 2) of sleeve 15. Located on top of lid 14 is a wire stop 35 that extends vertically upward from lid 14 and is in axial alignment with the cylindrical opening 15*a* extending through sleeve 15. The wire stop 35 is spaced a distance x from the sleeve 15 with the distance x being sufficiently large so that one can visually determine if a wire inserted into cylindrical opening 15*a* in sleeve 15 extends completely through the sleeve 15. A feature of the wire stop 35 is that it enables an operator to determine if the wire in cylindrical opening 15*a* is in proper position in the wire cradle 15*c*. That is, since the wire 9 is axially extended into the cylindrical opening 15*c* any misalignment of the wire within the sleeve 15 may cause the wire to bend to a position where a proper electrical connection cannot be made with either the gang connector 25 or gang connector 26, which each including a gang of wire engaging blades. The wire stop 35 has a dual function in that allows one to on-the-go determine if the wire is properly positioned in cylindrical opening 15*a* in sleeve 15 and thus reducing the chances that a blind connection formed within sleeve 15 will be faulty. A second feature of wire stop 35 is that it prevents a wire in cylindrical opening 15*a* from extending to far out of sleeve 15 so that the wire interferes with closing the wire connector 10. That is, bringing the lid 14 into engagement with cover 30 as shown in FIG. 7. The spacing of wire stop 35 on lid is such that the wire end does not interfere with the securing of the lid 14 to the cover 13 as illustrated in FIG. 5B.

Figure 4A:
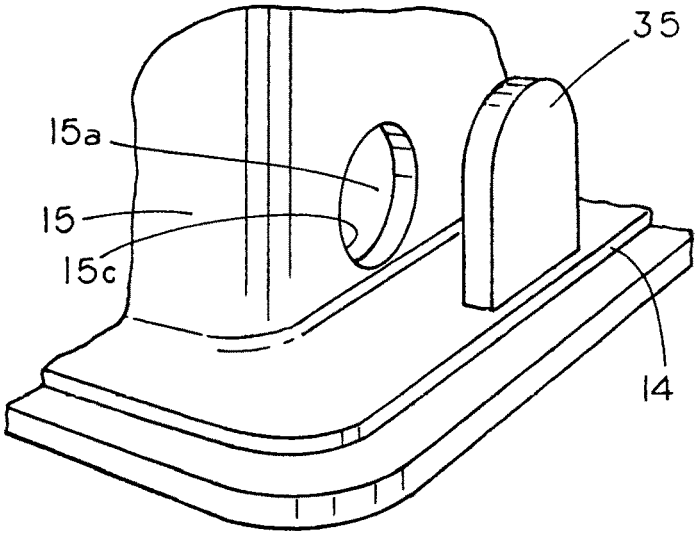
FIG. 4A is a partial perspective view of a wire stop of the insulation displacement connector.

FIG. 4A is an isolated view showing wire stop 35 secured to lid 14 with the wire stop positioned in front of cylindrical opening 15*a* in sleeve 15 and in a position to engage a wire extended axially through cylindrical opening 15*a*. In this example wire stop 35 is located in axial alignment with transverse opening 15*a* with the stop 35 spaced from sleeve 15 so that a wire cut end inserted through the transverse opening 15*a* and into engagement with the wire stop 35 is visible outside the sleeve 15 to enable a person to quickly determine if the blind electrical connections can be properly formed in sleeve 15.

Figure 5A:
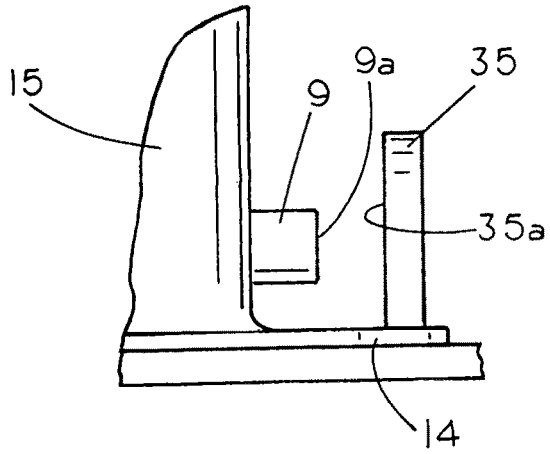
FIG. 5A is a partial perspective view of a wire extended through a sleeve.
Figure 5B:
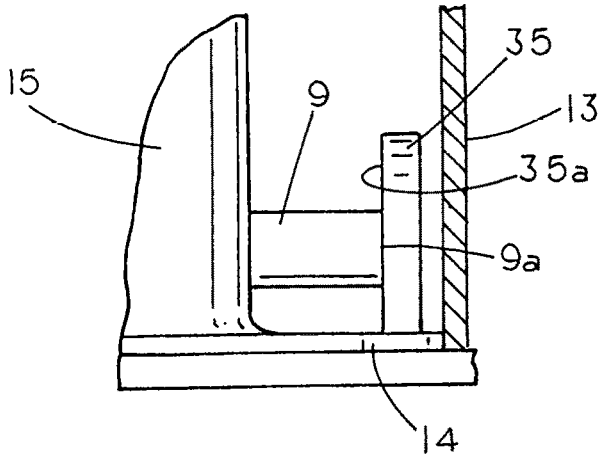
FIG. 5B is a partial side view of a wire engaged with the wire stop of the insulation displacement connector.

FIG. 5A is an isolated side view showing a portion of lid 14 and wire 9 in the process of being axially extended though sleeve 15 with the wire end 9*a* and the wire stop surface 35*a* in parallel or substantially parallel relationship to each other to stop or limit the insertion of wire 9. That is, as the wire end 9*a* contacts the wire stop surface 35*a* the wire 9 is urged to stop rather than deflecting laterally. Note, the wire end 9*a* is spaced from stop 35 so there is sufficient space to ensure that the wire 9 is through sleeve 15 and in engagement with stop 35 and sufficiently close to sleeve 15 so as to limit the wire from bending or flexing and avoiding contact with stop 35. FIG. 5B shows the wire 9 after axial extension with the wire end 9*a* in abutting or face-to-face engagement with wire stop surface 35*a* to prevent further insertion of the wire 9 therein. When the cover 13 and lid 14 are in the closed condition the wire end 9*a* is spaced from the cover 13. That is, FIG. 5 shows the stop 35 located inward of the cover 13 to stop the wire before it gets to a position where closing the cover 13, would interfere with the lid 14 properly engaging cover 13. Thus, a further feature of the wire stop 35 is that it stops over insertion of the wire 9 into sleeve 15.

FIG. 5 is a top view showing the main or uncut wire 8 extending through the sleeve 15 and the end of branch wire 9 abutting against wire stop 35 with both wires 8 and 9 in a ready position for forming an electrical connection therebetween by forcing piston 12 and piston 11 into sleeve 15 to form a blind connection of the gang connectors 25 and 26 to wire 8 and wire 9. The ability to extend wire 9 through the sleeve 24 and into engagement with the stop 35 allows one to determine if wire 9 is properly located inside sleeve 15 and thus minimizes the difficulty in forming a blind connection between the gang connectors and the wire 8 and wire 9 located within sleeve 15.

Figure 6:
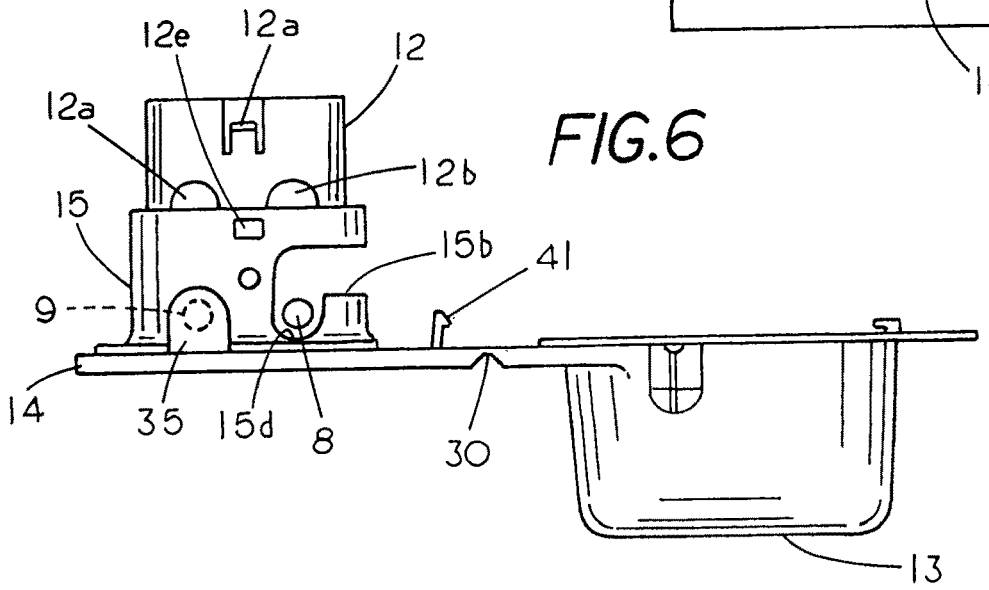
FIG. 6 is a side view showing the insulation displacement connector with the wire stop.

FIG. 6 is a back view of the connector 10 showing main wire 8 resting in wire cradle 15*d* in a position to be connected to wire 9 (dashed line), which is on the back side of wire stop 35. Once the wires are in position shown in FIG. 5 and FIG. 6 the piston 11 and piston 12 can be forced downward into sleeve 15 to form multiple electrical connections between wire 8 and wire 9 through gang connectors 25 and 26 that are brought into engagement with the wires located in the wire cradles 15*c* and 15*d*. FIG. 6 shows that piston 12 includes a resilient latch 12*a* for engaging a latch receptacle 12*e* on sleeve 15 to hold the piston 12 and the wire connectors therein in electrical engagement with both wire 8 and 9 in the same manner latch 11*a* engages piston 11 with sleeve 15. As illustrated in FIG. 1 and FIG. 6 the piston 11 and the piston 12 are latchable with the sleeve 15 to maintain the piston 11 and the piston 12 in a wire connecting position. Once the electrical connection is formed within sleeve 15 the hinge 30 is used to fold the lid 14 into engagement with cover 13 and thereby encapsulate the sleeve 15 and the connections therein. In the closed condition a latch 41 on lid 14 engages a lip 42 in cover 13 to hold the wire connector 10 in a closed condition as shown in FIG. 7 with wire 8 and wire 9 extending outward from the wire connector through the flaps 13*c* to hold sealant 40 within cover 13 while also permitting the closing of the cover 13 to the lid 14 without damaging the wires 8 and 9. Similarly, the flaps 13*a* and 13*b*, which are shown in FIG. 1, hold sealant 40 within cover 13 and also permit the closing of the cover 13 on the lid 14 without damaging the wires 8 or 9.

Figure 6A:
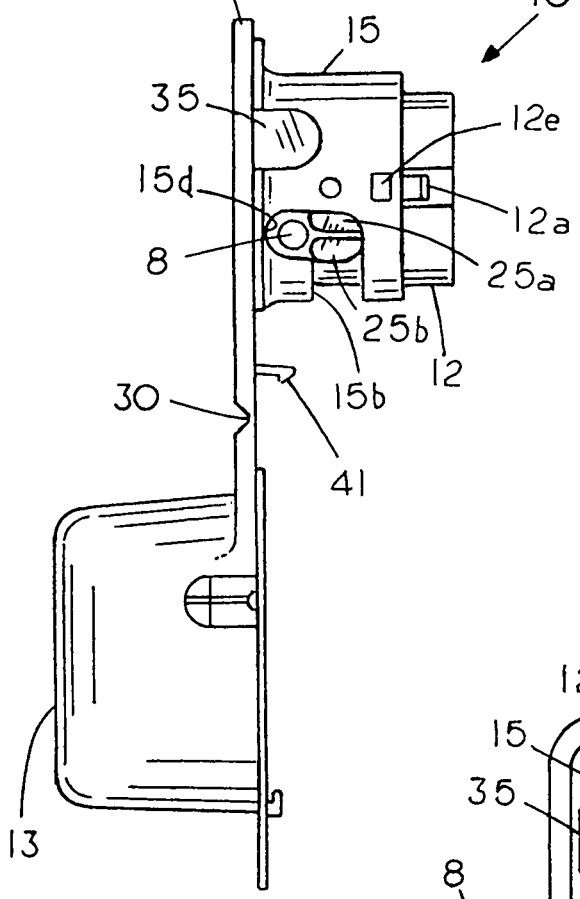
FIG. 6A is a side view showing the open insulation displacement connector suspended on a wire.
Figure 6B:
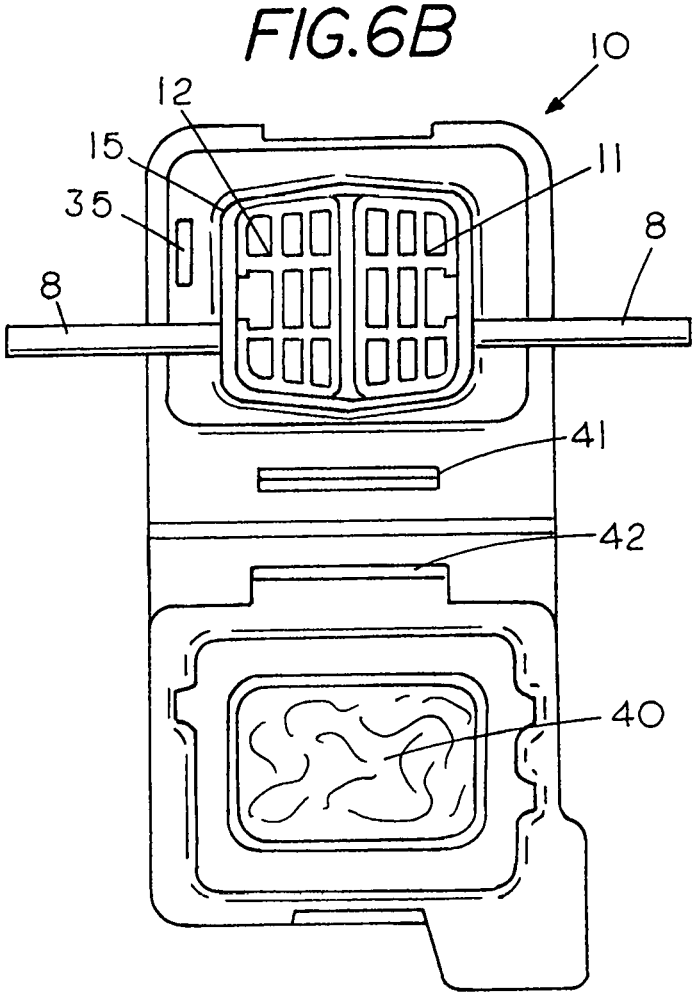
FIG. 6B is a front view showing the open insulation displacement connector suspended on an a wire extending through the connector.

FIG. 6A is a side view and FIG. 6B is a front view showing a two-step feature of open insulation displacement connector 10 that allows connector 10 to be suspended from or engaged with the main uncut wire 8 without the connector blades 25 and 26 being in electrical engagement with wire 8. In the first step as shown in FIG. 6A piston 11 and piston 12 are extending partially into sleeve 15 to maintain wire 8 within connector 10 without actually electrically engaging wire 8 with blades 25*a* and 25*b*. In contrast, FIG. 6 shows piston 11 and 12 in a full-retracted condition so that main wire 8, which is not cut, can be laterally inserted into the lateral opening 15*b*. Once the main or uncut wire 8 is laterally inserted therein one pushes piston 11 and piston 12 partway into sleeve 25 to extend the blades 25*a* and 25 slightly past the lateral opening 15*b*. This step captures wire 8 within the connector 10 without forming an electrical connection thereto. In this example the frictional resistance between sleeve 15 and piston 11 and piston 12 maintains the pistons with the cutting blades 25*a* and 25*b* in a static or ready condition as shown in FIG. 6A. Thus, a feature of connector 10 is that it allows one to ready main or uncut wire 8 for an electrical connection without having to complete the electrical connection to the main or uncut wire 8. This feature provides for ease in positioning connector 10 along wire 8 as one can slide the wire connector 10 along wire 8 until the connector 10 is in a proper position for electrical attachment of the branch wire thereto. Once in proper position the branch wire 9 is inserted into the circular opening 15*a* with the wire 9*a* brought into end brought into engagement with stop 35 as shown in FIG. 5B. In the next step one pushes piston 11 and piston 12 fully into sleeve 12, which simultaneously forms an electrical connection to both the main wire and the branch wire with gang connector 25 and gang connector 26.

Figure 6C:
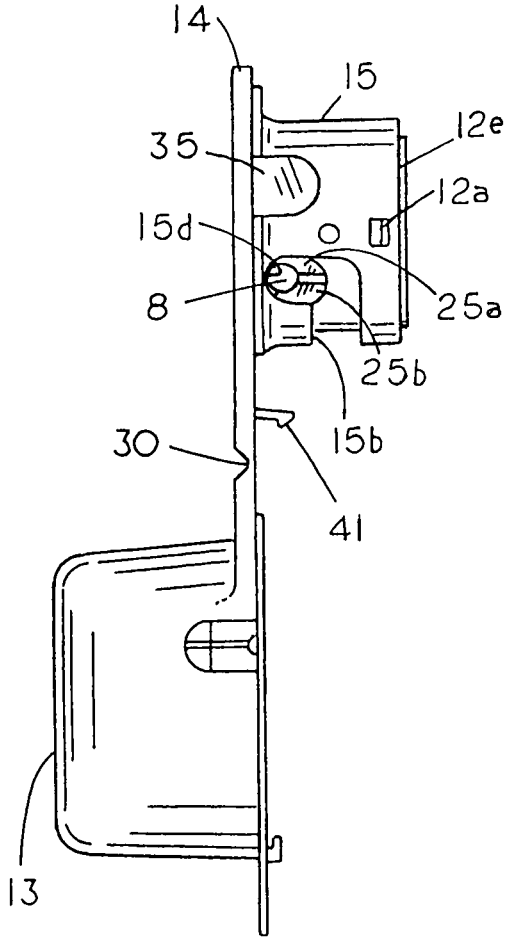
FIG. 6C is a side view showing the pistons and the ganged connectors in a wire connection position with the pistons latched to the sleeve.

FIG. 6C is a side view showing piston 11 and piston 12 located in a wire connection position in sleeve 12. In this position the electrical connection between wire 8 and 9 has been formed within the sleeve 15. To maintain the connection piston 11 latches to sleeve 15 through latches 11*a* and 15*a* (FIG. 1) and piston 12 latches to sleeve 15 through latches 12*a* and 12*e* (FIG. 6A).

As described herein the invention includes a method of forming a blind connection for a branch wire 9 to a continuous or uncut main wire 8 by inserting the main wire 8 into a first lateral opening 15*b* in a sleeve 15 having a wire cradle 15*d* that extends through sleeve 15. A gang connector 25 and a gang connector 26 are located above the main wire 8 with the gang connectors axially slideable into wire engagement with the main wire 8 and a branch wire 9. As shown in FIG. 4 and FIG. 5 one can also axially insert a branch wire 9 through the sleeve 15 and into engagement with stop 35 to limit axial insertion of the branch wire therein. Once the branch wire and the main wire are located in sleeve 15 with the branch wire 9 in contact with stop 35 one can force the gang connectors 25 and 26 into electrical engagement with both the main wire 8 and the branch wire 9 by pushing piston 11 and piston 12 into sleeve 15. Although two sets of gang connectors are shown and described more or less gang connectors may be used without departing from the spirit and scope of the invention. Once the electrical connections are formed in sleeve 15 the lid 14 carrying the sleeve 15 is folded into the sealant 40 in cover 13, as shown in FIG. 7, to provide for encapsulation and protection of the insitu electrical wire connections formed in sleeve 15.

We claim:

1. A wire connector comprising a housing;

a lid attachable to said housing:

a sleeve located on said lid with said sleeve having a side opening and a transverse opening extending therethrough;

a set of wire engaging blades mounted in a slideable piston; and a wire stop located in alignment with said transverse opening and spaced from said sleeve so that a wire end of a further wire inserted through the transverse opening and into engagement with the wire stop is visible outside the sleeve.

2. The wire connector of claim 1 wherein the set of wire engaging blades are slideable into a wire holding position when the piston is inserted partially into the sleeve to trap a wire in the side opening of the sleeve without forming an electrical connection to the wire and an electrical connection position with the wire engaging blades in electrical connection with the wire located in the side opening of the sleeve and the further wire located in the transverse opening of the sleeve.

3. The wire connector of claim 1 wherein the set of wire engaging blades comprise a gang of wire engaging blades each having at least two sets of blunt edge blades for engaging a first wire in the side opening and at least two sets of blunt edge blades for engaging a wire in the transverse opening sleeve.

4. The wire connector of claim 1 wherein the housing contains a sealant and the lid comprises a foldable lid hingedly connected to the housing so that the sleeve can be immersed in the sealant by folding the lid onto the housing.

5. The wire connector of claim 1 wherein the wire end extending through the transverse opening in the sleeve is in engagement with the wire stop.

6. The wire connector of claim 1 wherein the set of wire engaging blades are mounted in a first piston and a further set of wire engaging blades are mounted in a second piston with the wire engaging blades in the first piston and the further set of wire engaging blades in the second piston slideable into an electrical connection of an uncut wire located in the side opening of the sleeve and a wire in the transverse opening in the sleeve with the first piston and the second piston latchable to maintain the first piston and the second piston in a wire connecting position.

7. The wire connector of claim 6 wherein the piston and the further slideable piston are each independently slideable in the sleeve.

8. The wire connector of claim 6 including a divider located in the sleeve with the first slideable piston located on one side of the divider and the second slideable piston located on the other side of the divider.

9. The wire connector of claim 8 including a sealant located on said housing with a latch on said lid for securing said lid to said housing with the sleeve and the electrical connection immersed in the sealant.

10. The wire connector of claim 1 wherein the sleeve includes a latch for engaging a piston to maintain the piston in a locked condition in the sleeve.

11. A method of forming a blind connection comprising the steps of:

inserting a main wire into a first opening in a sleeve having a gang connector located above the main wire with the gang connector axially slideable into wire engagement with the main wire;

inserting a branch wire through the sleeve and into engagement with a stop to limit axial insertion of the branch wire therein; and forcing the gang connector into electrical engagement with both the main wire and the branch wire; and wherein the method further comprises visually determining if the branch wire extends through the sleeve.

12. The method of claim 11 including the step of inserting a main wire comprise inserting an insulation covered main wire and inserting a branch wire comprises inserting an insulation covered branch wire into the sleeve.

13. A method of forming a blind connection comprising:

inserting a main wire into a first opening in a sleeve having a gang connector located above the main wire with the gang connector axially slideable into wire engagement with the main wire;

inserting a branch wire through the sleeve and into engagement with a stop to limit axial insertion of the branch wire therein; and forcing the gang connector into electrical engagement with both the main wire and the branch wire; and wherein the method further comprises bringing together a lid carrying the sleeve and a cover having a sealant to encapsulate the sleeve and an electrical connection between the branch wire and the main wire.

14. The method of claim 11 including the step of laterally inserting the main wire into a wire cradle located in the sleeve.

15. The method of claim 14 including the step of axially inserting the branch wire into a further wire cradle located in the sleeve.

16. The method of claim 11 including the step of forcing at least two gang connectors each having a set of blunt edges into the sleeve to simultaneously remove insulation and form an electrical connection thereto.

17. The method of claim 11 including the step of placing the main wire on a first wire cradle in the sleeve and the branch wire on a second wire cradle in the sleeve with the first wire cradle and the second wire cradle located in a side-by-side connections in the sleeve.

18. The method of claim 17 wherein placing the main wire in the first cradle and placing the branch wire in the second cradle comprises placing the main wire and the branch wire in a parallel location within the sleeve.

19. A method of forming a blind connection comprising:

inserting a main wire into a first opening in a sleeve having a gang connector located above the main wire with the gang connector axially slideable into wire engagement with the main wire;

inserting a branch wire through the sleeve and into engagement with a stop to limit axial insertion of the branch wire therein; and forcing the gang connector into electrical engagement with both the main wire and the branch wire; and wherein the method further comprises inserting a cut end of the branch wire into a face-to-face engagement with the stop with the stop located outside the sleeve.

* * * * *